US012012818B2

(12) United States Patent
Emmett et al.

(10) Patent No.: US 12,012,818 B2
(45) Date of Patent: Jun. 18, 2024

(54) NESTED LOCK SCREW

(71) Applicant: CACTUS WELLHEAD, LLC, Houston, TX (US)

(72) Inventors: Jacob Emmett, Houston, TX (US); Bradley Jones, Pearland, TX (US)

(73) Assignee: CACTUS WELLHEAD, LLC, Houston, TX (US)

( * ) Notice: Subject to any disclaimer, the term of this patent is extended or adjusted under 35 U.S.C. 154(b) by 0 days.

(21) Appl. No.: 18/302,581

(22) Filed: Apr. 18, 2023

(65) Prior Publication Data

US 2023/0340852 A1 Oct. 26, 2023

Related U.S. Application Data

(60) Provisional application No. 63/334,112, filed on Apr. 23, 2022.

(51) Int. Cl.

| | |
|---|---|
| ***E21B 33/04*** | (2006.01) |
| ***E21B 23/02*** | (2006.01) |
| ***E21B 23/04*** | (2006.01) |
| ***F16L 19/00*** | (2006.01) |

(52) U.S. Cl.

CPC ..... *E21B 33/04* (2013.01)

(58) Field of Classification Search

None

See application file for complete search history.

(56) References Cited

U.S. PATENT DOCUMENTS

| | | | | |
|---|---|---|---|---|
| 3,434,743 | A * | 3/1969 | Boeker | E21B 33/04 411/395 |
| 4,291,768 | A * | 9/1981 | Diehl | F16J 15/185 166/88.4 |
| 4,650,226 | A * | 3/1987 | Babbitt | E21B 33/04 285/348 |
| 4,770,250 | A * | 9/1988 | Bridges | E21B 33/04 285/123.3 |
| 5,257,792 | A * | 11/1993 | Putch | E21B 33/03 285/123.3 |
| 6,595,278 | B1 * | 7/2003 | Lam | E21B 19/06 166/75.14 |
| 7,121,345 | B2 * | 10/2006 | Bartlett | E21B 33/043 166/344 |
| 9,303,481 | B2 | 4/2016 | Nguyen | |

(Continued)

*Primary Examiner* — Matthew Troutman
*Assistant Examiner* — Douglas S Wood
(74) *Attorney, Agent, or Firm* — Ewing & Jones, PLLC

(57) ABSTRACT

A wellhead assembly includes a wellhead housing, the wellhead housing including a lock screw receptacle. The wellhead assembly includes an outer nested wellhead component positioned within the wellhead housing, the outer nested wellhead component including a lock screw aperture. The wellhead assembly includes an inner nested wellhead component, the inner nested wellhead component including an inner receptacle. The wellhead assembly includes a nested lock screw. The nested lock screw includes an outer sleeve, the outer sleeve having external threads formed on an outer surface thereof, the outer sleeve threadedly coupled to the lock screw receptacle of the wellhead housing. The nested lock screw includes an inner lock screw, the inner lock screw positioned within and threadedly coupled to the outer sleeve, the inner lock screw passing through the lock screw aperture and engaging the inner receptacle.

19 Claims, 5 Drawing Sheets

(56) References Cited

U.S. PATENT DOCUMENTS

| | | | | |
|---|---|---|---|---|
| 10,138,697 | B2 * | 11/2018 | Guidry | E21B 33/03 |
| 10,287,839 | B2 * | 5/2019 | Lugtmeier | E21B 33/04 |
| 11,566,485 | B1 * | 1/2023 | Oliphant | E21B 33/068 |

* cited by examiner

NESTED LOCK SCREW

CROSS-REFERENCE TO RELATED APPLICATIONS

This application is a nonprovisional application which claims priority from U.S. provisional application No. 63/334,112, filed Apr. 23, 2022, which is incorporated by reference herein in its entirety.

TECHNICAL FIELD/FIELD OF THE DISCLOSURE

The present disclosure relates generally to wellhead equipment, and specifically to securing of components of a wellhead.

BACKGROUND OF THE DISCLOSURE

To secure wellhead equipment within an axial bore of a wellhead housing, lock screws may be positioned radially around the circumference of the wellhead housing to engage to the wellhead equipment. Lock screws typically have a conical nose and threaded outer diameter. Torque applied to the lock screw is translated into axial motion, driving the lock screw in and retaining wellhead equipment landed in the wellhead housing bore against pressure from below. Generally, only the conical nose of the lock screw extends into the wellhead bore. Lock screws are sealed individually—either by an interference seal or by a compression seal energized by an externally actuated gland.

Lock screws are the most common means of retaining hangers, packoffs, false bowls, and other equipment against wellbore pressure in wellhead systems. This is due to both the straightforward external access they provide and the lack of specialized tooling required to actuate them. They also have the added advantage of providing anti-rotation of the retained component—allowing landing joints and running tools to be easily broken out when required. Alternative means of retention, such as internal lock rings, require alternative mechanical solutions for anti-rotation.

Given the high-pressure contained and limited space available in wellhead equipment lock screws must be capable of withstanding stresses that approach the limits of their material strength. These stresses includes both axial stresses reacting against the threads in the lock screw gland and/or wellhead housing as well as the bending stresses through the cross section of the lock screw.

A nested hanger lands within a previously installed hanger, packoff, or false bowl rather than landing inside of the wellhead housing itself. This is desirable as it reduces the height of the wellhead system, reducing weight and cost.

Most traditional nested hangers rely on internal lock rings for retention in place of traditional lock screws. Lock rings often require specific OEM tooling and unique installation/retrieval processes that are not available to a typical workover crew to use without OEM support. In many regions it is costly and impractical for an end user to rely on the wellhead vendor who installed the equipment to be present to latch/unlatch the relevant hangers during routine workover operations.

SUMMARY

The present disclosure provides for a nested lock screw. The nested lock screw may include an outer sleeve, the outer sleeve having external threads formed on an outer surface thereof. The nested lock screw may include an inner lock screw, the inner lock screw positioned within and threadedly coupled to the outer sleeve.

The present disclosure also provides for a wellhead assembly. The wellhead assembly may include a wellhead housing, the wellhead housing including a lock screw receptacle. The wellhead assembly may include an outer nested wellhead component positioned within the wellhead housing, the outer nested wellhead component including a lock screw aperture. The wellhead assembly may include an inner nested wellhead component, the inner nested wellhead component including an inner receptacle. The wellhead assembly may include a nested lock screw. The nested lock screw may include an outer sleeve, the outer sleeve having external threads formed on an outer surface thereof, the outer sleeve threadedly coupled to the lock screw receptacle of the wellhead housing. The nested lock screw may include an inner lock screw, the inner lock screw positioned within and threadedly coupled to the outer sleeve, the inner lock screw passing through the lock screw aperture and engaging the inner receptacle.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
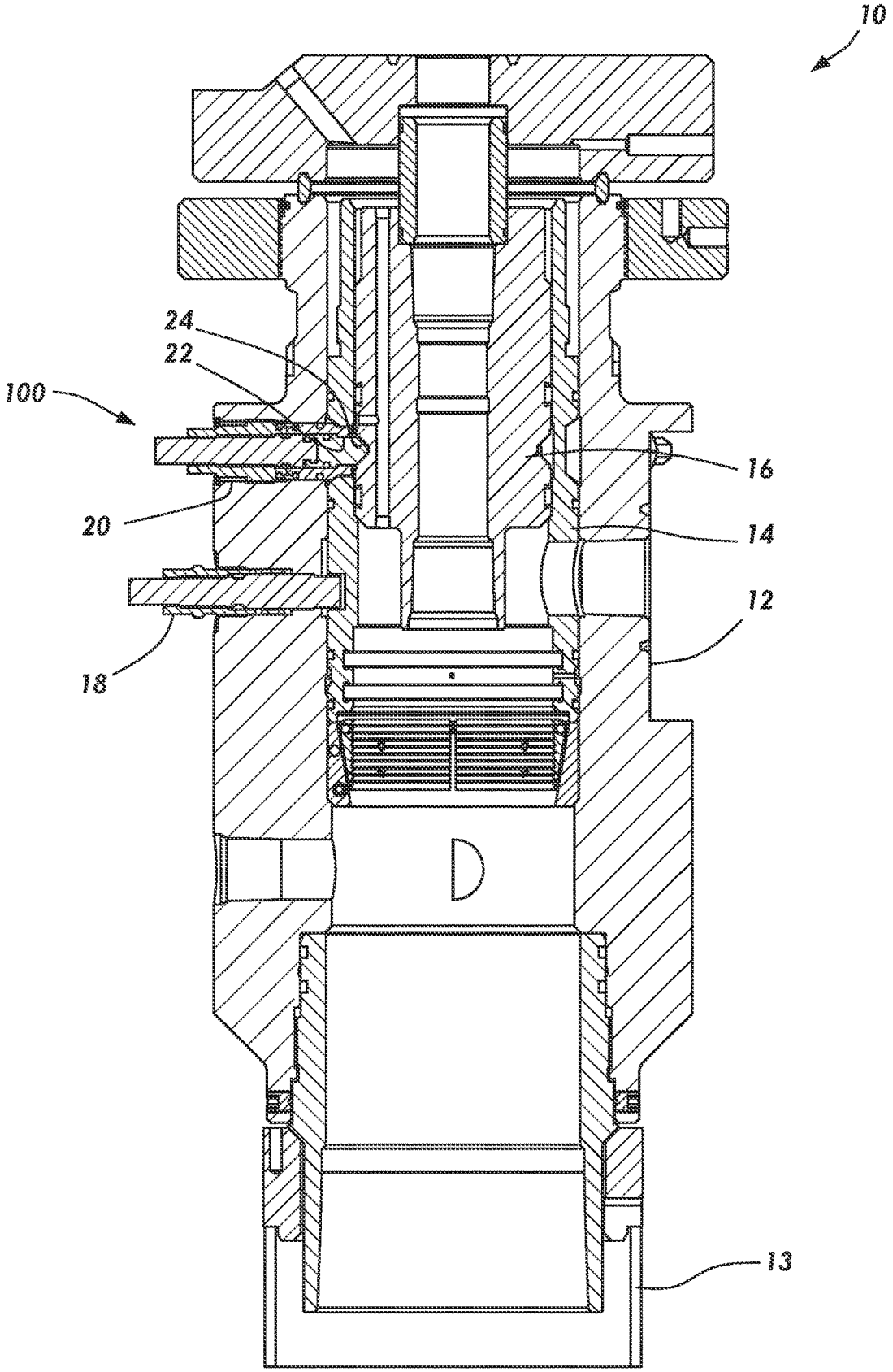
FIG. 1 depicts a cross section of a wellhead assembly including a nested lock screw consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a cross section view of wellhead assembly 10. Wellhead assembly 10 may include wellhead housing 12. Wellhead housing 12 may be mechanically coupled to a wellbore via casing 13 and may be used to house and support multiple components used within the wellbore including, for example and without limitation, outer nested wellhead component 14, depicted as a packoff, and inner nested wellhead component 16, depicted as a tubing hanger. Although discussed herein with respect to a packoff and tubing hanger, one of ordinary skill in the art with benefit of this disclosure will understand that these are mere examples of components that can be used with a nested lock screw as discussed herein below. For example, other equipment may include one or more of wear bushings, bit guides, seal packoffs, temporary abandonment plugs, tieback hangers, and drilling adapters. In some embodiments, as shown in FIG. 1, wellhead assembly 10 may be a nested hanger, wherein inner nested wellhead component 16 is positioned radially within outer nested wellhead component 14. In some embodiments, outer nested wellhead component 14 may be secured in place to wellhead housing 12 by one or more traditional lock screws 18.

In some embodiments, one or more components of wellhead assembly 10 may be secured together using one or more nested lock screws 100. For example, in some embodiments, as shown in FIG. 1, outer nested wellhead component 14 may be positioned within wellhead housing 12, and inner nested wellhead component 16 is positioned within outer nested wellhead component 14. Inner nested wellhead component 16 may be secured within outer nested wellhead component 14 and wellhead housing 12 by nested lock screw 100. Nested lock screw 100 may be secured to and extend through lock screw receptacle 20 formed in wellhead housing 12 and lock screw aperture 22 formed in outer nested wellhead component 14 to engage with inner receptacle 24 as further described below.

Figure 2:
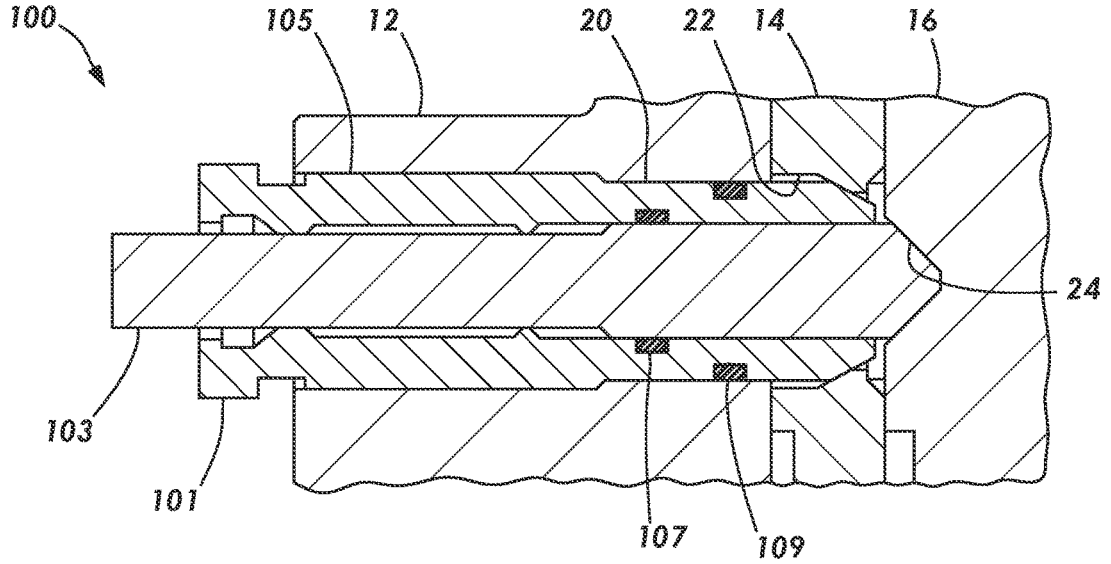
FIG. 2 depicts a cross section of a nested lock screw consistent with at least one embodiment of the present disclosure.

In some embodiments, as shown in FIG. 2, nested lock screw 100 may include outer sleeve 101 and inner lock screw 103. In some embodiments, outer sleeve 101 may include external threads 105 formed on an outer surface thereof. External threads 105 may be adapted to engage with threads formed in lock screw receptacle 20 of wellhead housing 12 to allow nested lock screw 100 to secure to wellhead housing 12 by threadedly connecting outer sleeve 101 to wellhead housing 12. Rotation of outer sleeve 101 may thereby allow outer sleeve 101 to extend or retract relative to wellhead housing 12 as further discussed below. For example, outer sleeve 101 may, when extended into the interior of wellhead housing 12, engage lock screw aperture 22 of outer nested wellhead component 14. In some embodiments, outer sleeve 101 may be used to secure or orient outer nested wellhead component 14 to wellhead housing 12.

In some embodiments, inner lock screw 103 may be threadedly coupled to outer sleeve 101 such that rotation of inner lock screw 103 relative to outer sleeve 101 may extend or retract inner lock screw 103 relative to outer sleeve 101. The position of outer sleeve 101 relative to wellhead housing 12 may therefore be adjustable independently from the position of inner lock screw 103 relative to outer sleeve 101. In some embodiments, the clearance between outer sleeve 101 and inner lock screw 103 may be of generally tight tolerance such that, for example and without limitation, inner lock screw 103 engages outer sleeve 101 at a distal end thereof, thereby supporting inner lock screw 103 against bending stresses incurred while nested lock screw 100 is used to secure components of wellhead assembly 10.

In some embodiments, nested lock screw 100 may include one or more internal seals 107 positioned to form a fluid seal between outer sleeve 101 and inner lock screw 103. In some embodiments, nested lock screw may include one or more external seals 109 positioned to form a fluid seal between outer sleeve 101 and wellhead housing 12. Internal seals 107 and external seals 109 may reduce or prevent fluid egress from within wellhead assembly 10.

Figure 3:
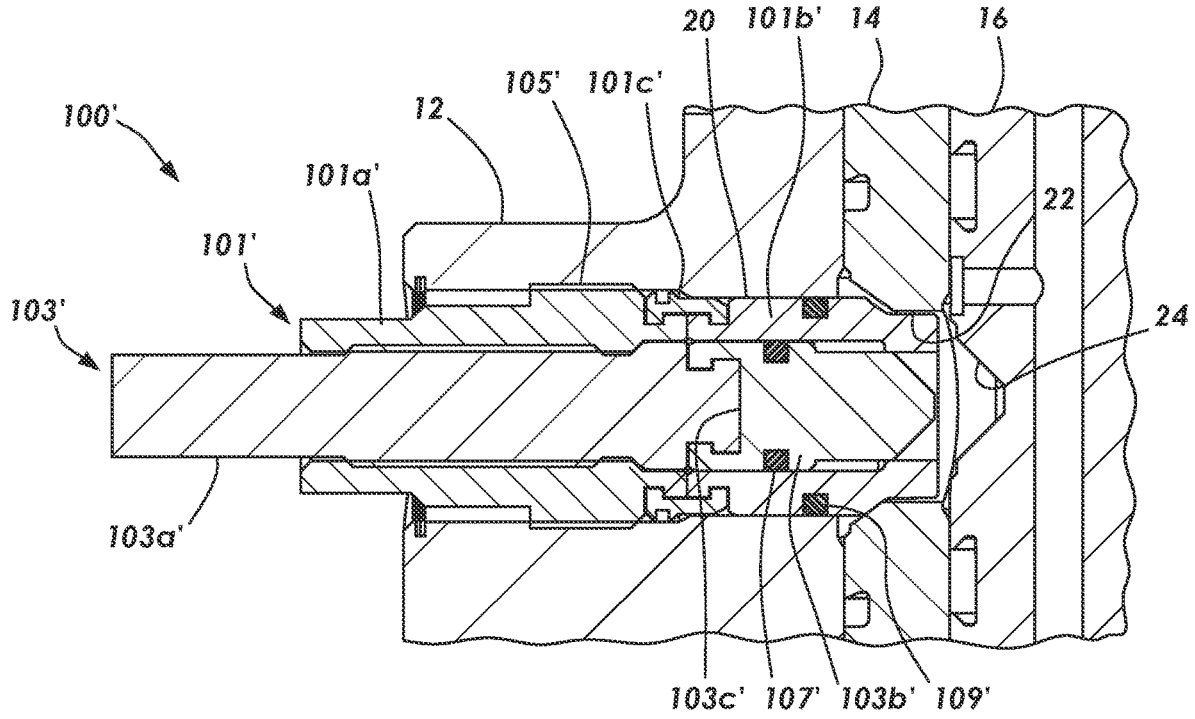
FIG. 3 depicts a cross section of a nested lock screw consistent with at least one embodiment of the present disclosure.

In some embodiments, as shown in FIG. 3, nested lock screw 100' may include two-part outer sleeve 101'. Two-part outer sleeve 101' may include rotating outer sleeve 101*a*' and non-rotating outer sleeve 101*b*'. Rotating outer sleeve 101*a*' and non-rotating outer sleeve 101*b*' may be mechanically coupled together by outer sleeve coupler 101*c*' such that rotating outer sleeve 101*a*' and non-rotating outer sleeve 101*b*' may rotate relative to each other while remaining axially aligned and substantially in abutment. In some such embodiments, external threads 105' may be formed in rotating outer sleeve 101*a*' such that as nested lock screw 100' is installed to wellhead housing 12, rotating outer sleeve 101*a*' is able to rotate and threadedly couple thereto while non-rotating outer sleeve 101*b*' may move only axially without rotation relative to wellhead housing 12. Such non-rotation may, for example and without limitation, reduce wear on components of wellhead assembly 10, non-rotating outer sleeve 101*b*', and external seals 109' positioned between non-rotating outer sleeve 101*b*' and wellhead housing 12.

In some embodiments, nested lock screw 100' may include two-part inner lock screw 103'. Two-part inner lock screw 103' may include rotating inner lock screw 103*a*' and non-rotating inner lock screw 103*b*'. Rotating inner lock screw 103*a*' and non-rotating inner lock screw 103*b*' may be mechanically coupled together by a coupler or, as shown in FIG. 3, by dovetail 103*c*' such that rotating inner lock screw 103*a*' and non-rotating inner lock screw 103*b*' may rotate relative to each other while remaining axially aligned and substantially in abutment. In some such embodiments, the threaded engagement between two-part inner lock screw 103' and two-part outer sleeve 101' may be formed between rotating outer sleeve 101*a*' and rotating inner lock screw 103*a*' such that rotating inner lock screw 103*a*' is able to rotate and threadedly extend into wellhead housing 12, non-rotating inner lock screw 103*b*' may move only axially without rotation relative to non-rotating outer sleeve 101*b*' and wellhead housing 12. Such non-rotation may, for example and without limitation, reduce wear on components of wellhead assembly 10, non-rotating outer sleeve 101*b*', non-rotating inner lock screw 103*b*', and internal seals 107' positioned between non-rotating inner lock screw 103*b*' and non-rotating outer sleeve 101*b*'.

Figure 4:
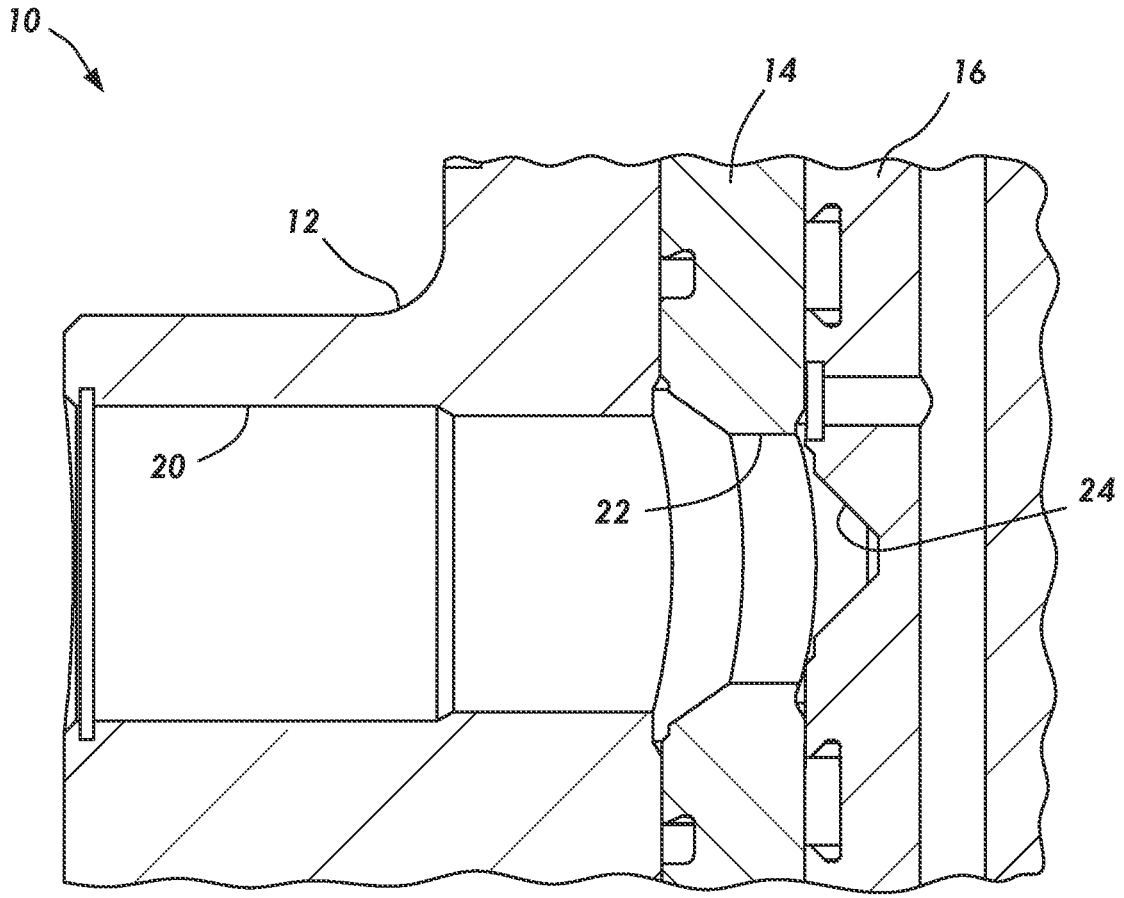
FIG. 4 depicts a cross section of a nested hanger assembly of a wellhead having a lock screw receptacle for a nested lock screw consistent with at least one embodiment of the present disclosure.
Figure 5:
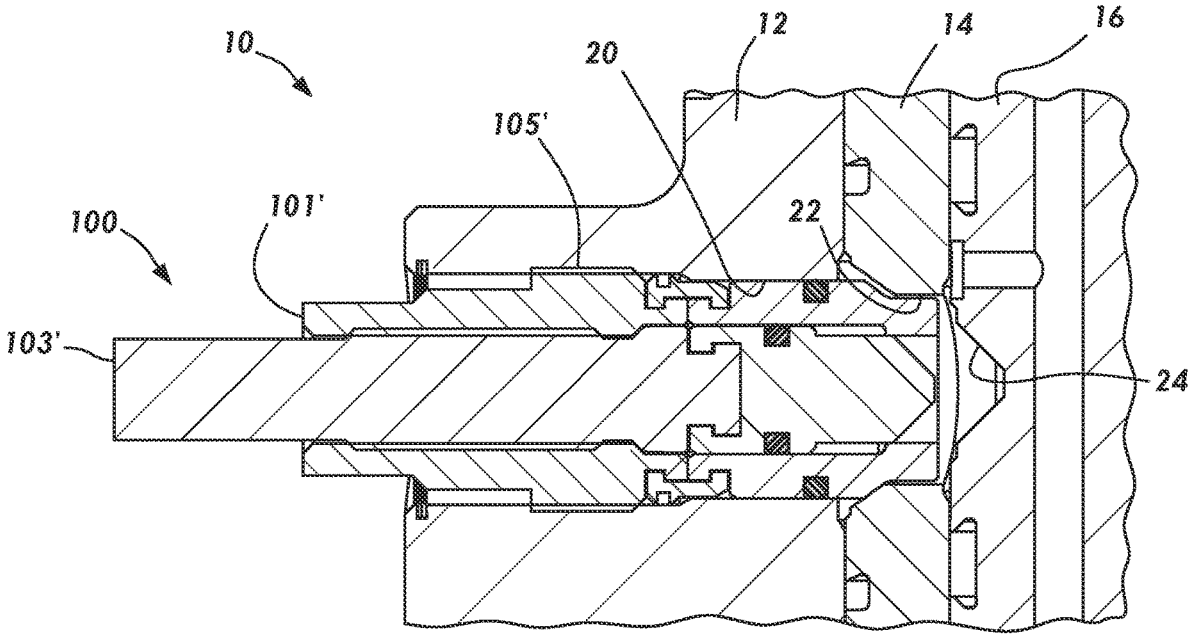
FIG. 5 depicts a cross section view of the nested hanger assembly of FIG. 4 with an outer pin of the nested lock screw engaged.
Figure 6:
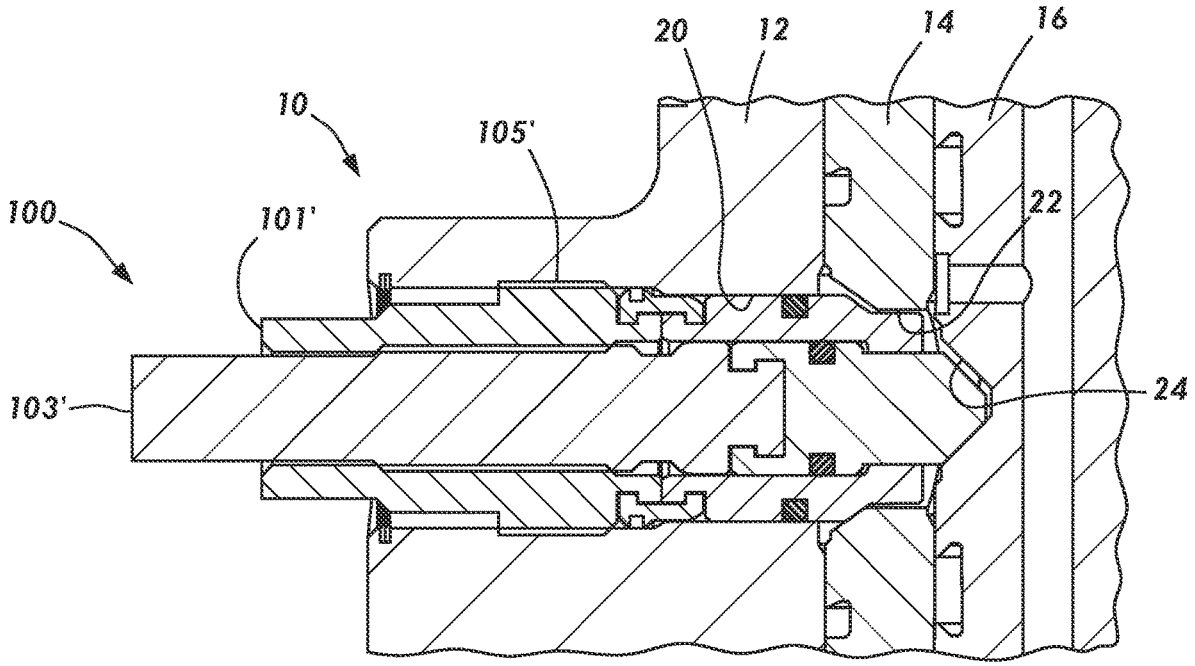
FIG. 6 depicts a cross section view of the nested hanger assembly of FIG. 5, with an inner pin of the nested lock screw engaged.

FIGS. 4-6 depict the stages of installation of nested lock screw 100' to wellhead assembly 10. Although nested lock screw 100' having two-part outer sleeve 101' and two-part inner lock screw 103' is shown, the operations described are substantially identical for nested lock screw 100 having outer sleeve 101 and inner lock screw 103.

As shown in FIG. 4, wellhead assembly 10 may first be made up such that components of wellhead assembly 10 are in place and ready for assembly or components may be installed sequentially during the securing operations described below. For example, outer nested wellhead component 14 and inner nested wellhead component 16 may be positioned within wellhead housing 12 such that lock screw aperture 22 and inner receptacle 24 are aligned with lock screw receptacle 20.

Nested lock screw 100' may then be installed to wellhead housing 12 by inserting nested lock screw 100' into lock screw receptacle 20 and rotating two-part outer sleeve 101' of nested lock screw 100' as shown in FIG. 5. In other embodiments, nested lock screw 100' may be installed to wellhead housing 12 before outer nested wellhead component 14 and inner nested wellhead component 16 are positioned within wellhead housing 12. In some embodiments, once outer nested wellhead component 14 is installed into wellhead housing 12, two-part outer sleeve 101' may be rotated until two-part outer sleeve 101' engages lock screw aperture 22 and is fully seated thereto.

In some embodiments, two-part inner lock screw 103' may then be rotated until two-part inner lock screw 103' engages inner receptacle 24 and is fully seated thereto as shown in FIG. 6. By engaging inner receptacle 24, two-part inner lock screw 103' may secure inner nested wellhead component 16 or other inner nested wellhead component both axially and rotationally within wellhead housing 12. In some embodiments, because two-part outer sleeve 101' is extended to abut or nearly abut inner nested wellhead component 16, the cantilever distance of two-part inner lock screw 103' may be reduced as compared to a single-piece lock screw, thereby reducing bending moments imparted on two-part inner lock screw 103'.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A nested lock screw, comprising:

an outer sleeve, the outer sleeve having external threads formed on an outer surface thereof;

an external seal positioned around an outer circumference of the outer sleeve;

an inner lock screw, the inner lock screw positioned within and threadedly coupled to the outer sleeve, wherein the inner lock screw comprises a non-rotating inner lock screw and a rotating inner lock screw, the non-rotating inner lock screw and the rotating inner lock screw rotatably coupled together, wherein threaded coupling between the inner lock screw and the outer sleeve is formed between the rotating inner lock screw and the outer sleeve; and an internal seal positioned around an outer circumference of the inner lock screw within an annulus formed between the inner lock screw and the outer sleeve.

2. The nested lock screw of claim 1, wherein the external seal is positioned on a non-rotating portion of the outer sleeve.

3. The nested lock screw of claim 1, wherein the internal seal is positioned on a non-rotating portion of the inner lock screw.

4. The nested lock screw of claim 1, wherein the outer sleeve comprises a non-rotating outer lock sleeve and a rotating outer lock sleeve, wherein the external threads are formed on the rotating outer lock sleeve, wherein the non-rotating outer lock sleeve and the rotating outer lock sleeve are rotatably coupled together by an outer sleeve coupler.

5. The nested lock screw of claim 1, wherein the non-rotating inner lock screw and the rotating inner lock screw are rotatably coupled together with an inner screw coupler.

6. The nested lock screw of claim 1, wherein the inner lock screw is engaged with the outer sleeve at a distal end of the inner lock screw.

7. The nested lock screw of claim 1, wherein the outer sleeve is adapted to extend or retract relative to a wellhead housing when rotated.

8. A wellhead assembly, comprising:

a wellhead housing, the wellhead housing including a lock screw receptacle;

an outer nested wellhead component positioned within the wellhead housing, the outer nested wellhead component including a lock screw aperture;

an inner nested wellhead component, the inner nested wellhead component including an inner receptacle; and a nested lock screw, the nested lock screw including:

an outer sleeve, the outer sleeve having external threads formed on an outer surface thereof, the outer sleeve threadedly coupled to the lock screw receptacle of the wellhead housing; and an inner lock screw, the inner lock screw positioned within and threadedly coupled to the outer sleeve, the inner lock screw passing through the lock screw aperture and engaging the inner receptacle, wherein the inner lock screw comprises a non-rotating inner lock screw and a rotating inner lock screw, the non-rotating inner lock screw and the rotating inner lock screw rotatably coupled together, wherein threaded coupling between the inner lock screw and the outer sleeve is formed between the rotating inner lock screw and the outer sleeve.

9. The wellhead assembly of claim 8, further comprising an external seal positioned around an outer circumference of the outer sleeve and in abutment with the wellhead housing.

10. The wellhead assembly of claim 8, further comprising an internal seal positioned around an outer circumference of the inner lock screw within an annulus formed between the outer sleeve and the inner lock screw.

11. The wellhead assembly of claim 8, wherein the outer sleeve comprises a non-rotating outer lock sleeve and a rotating outer lock sleeve, wherein the external threads are formed on the rotating outer lock sleeve, wherein the non-rotating outer lock sleeve and the rotating outer lock sleeve are rotatably coupled together by an outer sleeve coupler.

12. A nested lock screw, comprising:

an outer sleeve, the outer sleeve having external threads formed on an outer surface thereof, wherein the outer sleeve comprises a non-rotating outer lock sleeve and a rotating outer lock sleeve, wherein the external threads are formed on the rotating outer lock sleeve, wherein the non-rotating outer lock sleeve and the rotating outer lock sleeve are rotatably coupled together by an outer sleeve coupler;

an external seal positioned around an outer circumference of the outer sleeve;

an inner lock screw, the inner lock screw positioned within and threadedly coupled to the outer sleeve; and an internal seal positioned around an outer circumference of the inner lock screw within an annulus formed between the inner lock screw and the outer sleeve.

13. The nested lock screw of claim 12, wherein the external seal is positioned on a non-rotating portion of the outer sleeve.

14. The nested lock screw of claim 12, wherein the internal seal is positioned on a non-rotating portion of the inner lock screw.

15. The nested lock screw of claim 12, wherein the inner lock screw comprises a non-rotating inner lock screw and a rotating inner lock screw, the non-rotating inner lock screw and the rotating inner lock screw rotatably coupled together, wherein threaded coupling between the inner lock screw and the outer sleeve is formed between the rotating inner lock screw and the outer sleeve.

16. The nested lock screw of claim 15, wherein the non-rotating inner lock screw and the rotating inner lock screw are rotatably coupled together with an inner screw coupler.

17. The nested lock screw of claim 15, wherein the rotating inner lock screw and the non-rotating inner lock screw are adapted to rotate relative to each other while remaining axially aligned.

18. The nested lock screw of claim 12, wherein the inner lock screw is engaged with the outer sleeve at a distal end of the inner lock screw.

19. The nested lock screw of claim 12, wherein the outer sleeve is adapted to extend or retract relative to a wellhead housing when rotated.

* * * * *